US010144121B2

(12) United States Patent
Sook

(10) Patent No.: US 10,144,121 B2
(45) Date of Patent: Dec. 4, 2018

(54) FASTENER HOLDER

(71) Applicant: Dominion Resources, Inc., Richmond, VA (US)

(72) Inventor: Timothy R. Sook, Portsmouth, VA (US)

(73) Assignee: Dominion Energy, Inc., Richmond, VA (US)

( * ) Notice: Subject to any disclaimer, the term of this patent is extended or adjusted under 35 U.S.C. 154(b) by 223 days.

(21) Appl. No.: 14/626,146

(22) Filed: Feb. 19, 2015

(65) Prior Publication Data

US 2015/0239112 A1 Aug. 27, 2015

Related U.S. Application Data

(60) Provisional application No. 61/942,640, filed on Feb. 21, 2014.

(51) Int. Cl.
*B25C 3/00* (2006.01)
*B25B 23/10* (2006.01)

(52) U.S. Cl.
CPC ..... *B25C 3/008* (2013.01); *B25B 23/10* (2013.01); *Y10T 29/49833* (2015.01)

(58) Field of Classification Search
CPC ..... B23B 23/10; B25C 3/008; B25C 3/005; B25B 21/002; B25B 21/023
See application file for complete search history.

(56) References Cited

U.S. PATENT DOCUMENTS

| | | | | |
|---|---|---|---|---|
| 874,613 | A | 12/1907 | McColm | |
| 2,648,066 | A * | 8/1953 | Ingraham | B25C 3/008 81/44 |
| 2,722,148 | A * | 11/1955 | Woyton | B25B 23/10 294/99.2 |
| 3,522,827 | A * | 8/1970 | Muller | B25C 3/008 294/99.2 |
| 4,018,334 | A | 4/1977 | Lejdegard | |
| 4,079,764 | A | 3/1978 | Hayes | |
| 4,079,765 | A | 3/1978 | Hatayan | |
| 4,422,489 | A | 12/1983 | Ross | |
| 4,966,056 | A | 10/1990 | Miller | |
| 5,284,070 | A | 2/1994 | Rieck | |
| 5,370,020 | A | 12/1994 | Fifield et al. | |
| 5,671,641 | A | 9/1997 | Stephenson, Jr. | |
| 5,733,085 | A | 3/1998 | Shida et al. | |
| 5,933,894 | A | 8/1999 | Bates | |
| 5,957,007 | A | 9/1999 | Righini | |
| D530,177 | S | 10/2006 | Alverson, Jr. | |

(Continued)

FOREIGN PATENT DOCUMENTS

GB 2 347 105 8/2000

*Primary Examiner* — Jacob Cigna
*Assistant Examiner* — Lee A Holly
(74) *Attorney, Agent, or Firm* — Blank Rome LLP

(57) ABSTRACT

An apparatus and method is provided for holding fasteners (such as lag screws) while being driven into a work piece. The holder holds the fastener away from a worker's hand so that it may be driven into the work piece without the hand being close to the driving action of the driving tool (such as a hammer). The holder then releases the screw to be completely driven into the work piece. While the fastener is being set, the holder holds one or more other fasteners in reserve.

22 Claims, 2 Drawing Sheets

(56) References Cited

U.S. PATENT DOCUMENTS

| | | | | |
|---|---|---|---|---|
| 7,198,446 | B2 * | 4/2007 | Yoshizawa | F16B 15/08 206/344 |
| 7,200,897 | B2 * | 4/2007 | Silvestro | G02C 3/04 24/3.3 |
| 7,874,778 | B1 | 1/2011 | Derrig et al. | |
| 2004/0040417 | A1 | 3/2004 | Davidson | |
| 2004/0243139 | A1 | 12/2004 | Lewis et al. | |
| 2005/0166713 | A1 | 8/2005 | Lloyd | |
| 2006/0101948 | A1 | 5/2006 | Meitzler et al. | |
| 2007/0144096 | A1 | 6/2007 | O'Neal | |
| 2010/0049243 | A1 * | 2/2010 | Luh | A45D 26/0066 606/208 |
| 2010/0132514 | A1 | 6/2010 | Morgan | |
| 2013/0118314 | A1 | 5/2013 | Eifes | |

* cited by examiner

FASTENER HOLDER

CROSS-REFERENCE TO RELATED APPLICATIONS

This application claims priority under 35 U.S.C. § 119(e) to U.S. Provisional patent Application No. 61/942,640, filed on Feb. 21, 2014, which is hereby incorporated by reference in its entirety herein.

BACKGROUND

Described embodiments relate generally to the field of holders for fasteners, and more particularly to holders for fasteners, such as lag screws, while being driven into a work piece.

Linemen working on electric power distribution systems often have to drive fasteners, such as lag screws, into wooden poles. Often multiple screws have to be driven for a job. In known methods, the lineman holds the lag screw and strikes it with hammer to set it into the pole. A driver or wrench may then be used to engage the fastener driving surfaces to screw it into the pole. There is potential for a hand injury every time one holds a lag screw and hits it with a hammer to drive it into a pole. Moreover, this task may be required while the lineman is up on the pole, or on a lift platform, in awkward or precarious positions, or in wet or extreme weather conditions, all that adversely affect manual dexterity and make handling and driving of the fasteners more difficult and injury more likely.

Some known holders for a fastener can hold only a single fastener (or a single fastener per opening/slot) at a time. US patent application publication 2006/0101948 to Meitzler magnetically holds a single fastener at a time. Additionally, GB 2 347 105 to Motley; U.S. Pat. No. 4,018,334 to Lejdegard; U.S. Pat. No. 4,079,764 to Hayes; U.S. Pat. No. 4,422,489 to Ross; U.S. Pat. No. 5,671,641 to Stephenson, Jr.; U.S. Pat. No. 5,933,894 to Bates; and U.S. Pat. No. 5,957,007 to Righini hold more than one fastener, but the holders include several openings, slots or holding locations, each of which holds a single fastener at a time.

Other known devices hold multiple staples. U.S. Pat. No. D530,177 to Alverson, Jr. and U.S. Pat. No. 4,966,056 to Miller hold multiple staples for insertion into a work piece, but each staple is held individually in a separate slot.

Some known devices hold fasteners with a lever-based or pliers-type feature, see U.S. Pat. No. 4,079,765 to Hatayan; U.S. Pat. No. 5,370,020 to Fifield et al.; US patent application publication 2004/0040417 to Davidson; US patent application publication 2005/0166713 to Lloyd; and US patent application publication 2013/0118314 to Eifes.

U.S. Pat. No. 5,733,085 to Shida et al. holds multiple nails together in position by adhesive. U.S. Pat. No. 874,614 to McColm supports several nails by their heads at the same time in slots. However, the holder of the '614 patent relies on gravity to hold the nails and thus is used in the horizontal position and not for vertical surfaces like wooden poles.

Accordingly, there is a desire for devices and methods that provide a tool that holds fasteners so that they may be safely and efficiently driven into a work piece.

SUMMARY

The described embodiments alleviate the problems of the prior devices and methods by providing a fastener holder for holding a plurality of fasteners to be driven and set in a work piece, including: a fastener slot having a first slot section and a second slot section; the first slot section for holding the plurality of fasteners and separated from the second slot section by a first narrow portion; the first narrow portion configured to require applied force for a fastener in the fastener slot to slide through from the first slot section to the second slot section, where the fastener is held to be driven and set in the work piece; the second slot section having an open end at the end of the slot; the open end having a second narrow portion; the second narrow portion configured to require applied force for the set fastener to slide through from the second slot section to exit the fastener slot.

In one aspect, the fastener holder includes a gripping bar, a gripping slot is formed in the gripping bar with an elastomeric material at the gripping slot to grip the fasteners, and the fastener slot includes the gripping slot, and the holder further includes a support material to support the elastomeric material.

In another aspect, the gripping bar has upper and lower surfaces, the support material is affixed to at least one of the upper and lower gripping bar surfaces, and the support material includes a support slot, the fastener slot including the support slot.

In another aspect, the fastener slot includes an open slot end and a closed slot end, and includes an wide portion configured for accepting insertion of a fastener into the slot.

In another aspect, there is provided a method of setting fasteners in a work piece, including the steps of: providing a fastener holder for holding a plurality of fasteners to be driven and set in a work piece, the holder including a slot having a first slot section and a second slot section, the first slot section for holding the plurality of fasteners and separated from the second slot section by a first narrow portion, the first narrow portion configured to require applied force for a fastener in the slot to slide through from the first slot section to the second slot section, where the fastener is held to be driven and set in the work piece, the second slot section having an open end at the end of the slot; the open end having a second narrow portion; the second narrow portion configured to require applied force for the set fastener to slide through from the second slot section to exit the slot; inserting one or more fasteners into the first slot section; sliding a fastener from the first slot section to the second slot section; driving the fastener in the second slot section to set in the work piece; and moving the fastener holder to the set fastener to slide through from the second slot section to exit the slot.

A fuller understanding of the disclosure may be had by referring to the following description and claims taken in conjunction with the accompanying drawings.

DETAILED DESCRIPTION OF PREFERRED EMBODIMENTS

The disclosure is directed to a holder for fasteners (such as lag screws) while being driven into a work piece, such as a vertical wooden pole. The screw stick holds the fastener away from a worker's hand so that it may be driven into the work piece, such as with a hammer, without the hand being close to the driving action, such as the striking of a hammer. The holder then allows the screw to be released from the tool so that it may be completely driven into the pole. The holder includes a slotted track for receiving the screws and for holding one or more screws at a time; friction holding of the screws within the track; and an open end to allow tool removal from the screw after setting, or initial screw insertion into the work piece. The holder may be formed of a rubber piece sandwiched between two metal pieces, however the disclosure is not limited to such a configuration.

Figure 1:
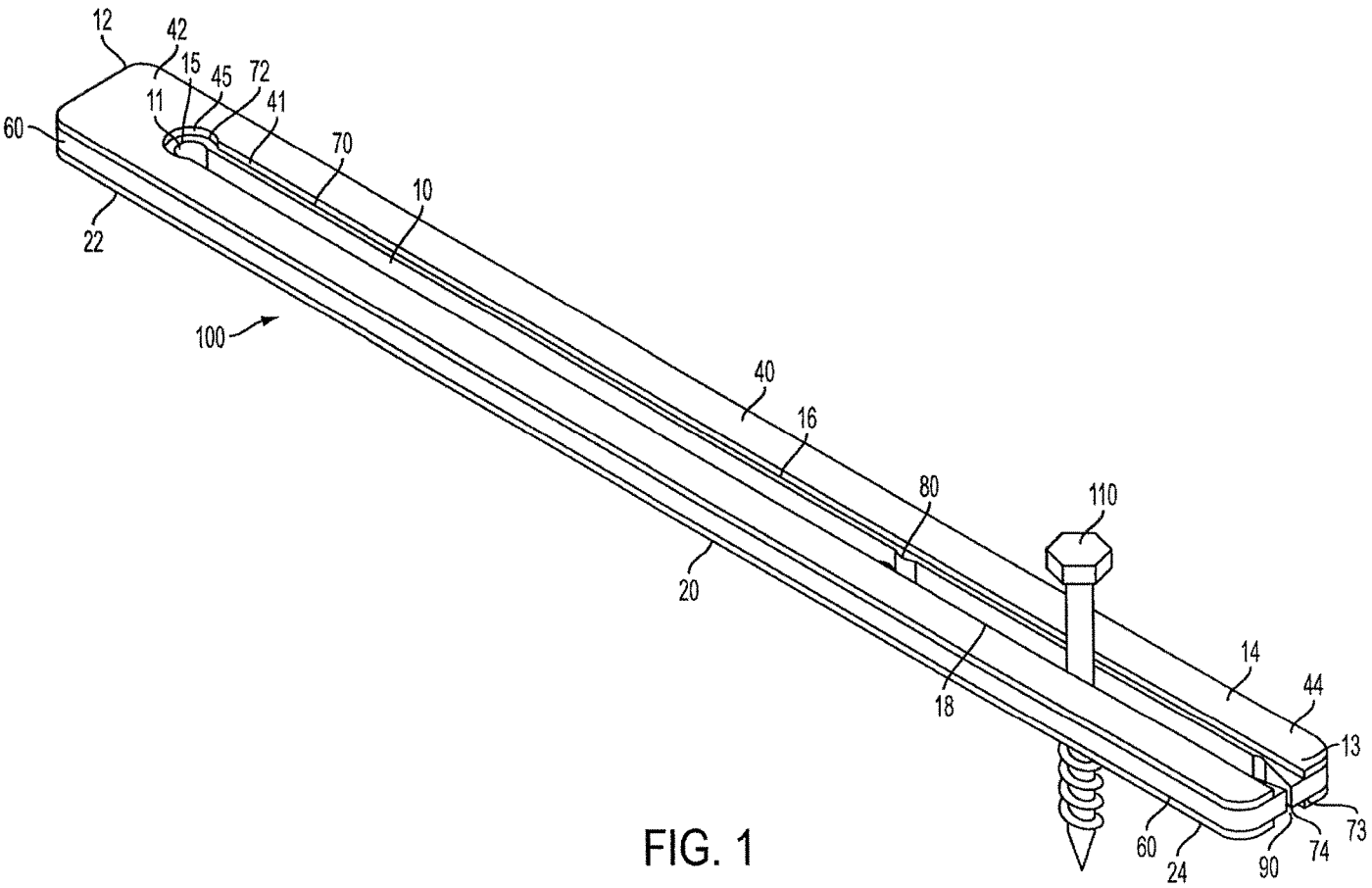
FIG. 1 is top perspective view of a screw stick, in accordance with embodiments described herein.
Figure 2:
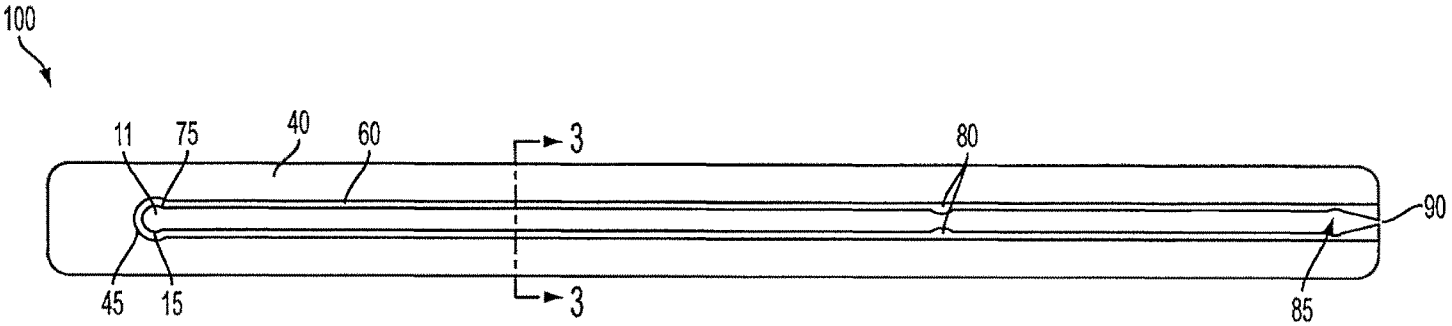
FIG. 2 is a top plan view of the screw stick of FIG. 1.
Figure 3:
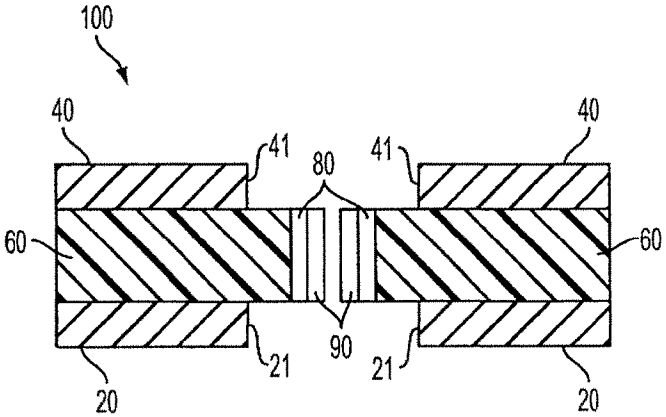
FIG. 3 is a section view taken along line 3-3 of FIG. 2.

Refer now to FIGS. 1 to 3, there being shown a screw stick, generally designated by reference numeral 100, according to a preferred embodiment. Screw stick 100 is a fastener holder for holding a plurality of fasteners 110 to be struck and set in a work piece. Screw stick 100 is elongated, having a first end 12, and a second end 14. A fastener slot 10 extends through the thickness of and along the length of the stick 100. The slot 10 is closed at its first end 11 closest to the first stick end 12. The slot 10 is open at its second end 13 at the stick second end 14.

The fastener slot 10 has a first slot section 16 and a second slot section 18. The first slot section 16 is for holding the plurality of fasteners before they are needed for use. The second slot section 18 is for holding a fastener to be struck and set in the work piece. The first slot section 16 is separated from the second slot section 18 by a first narrow portion 80 of slot 10. The first slot section 16 extends from the slot closed first end 11 to the first narrow portion 80.

The first narrow portion 80 is configured to require applied force for a fastener in the fastener slot 10 to slide through from the first slot section 16 to the second slot section 18. The second slot section 18 has an open end 74 at the end 13 of the slot 10. At the open end 74, the slot 10 has a second narrow portion 90 configured to require applied force for the set fastener to slide through from the second slot section 18 to exit the fastener slot 10 at the open end 14. The second slot section 18 extends from the first narrow portion 80 to the second narrow portion 90.

The fastener slot 10 includes a wide portion 15 configured for accepting insertion of a fastener into the slot 10. In the illustrated embodiment, the wide portion is at slot end 11.

The illustrated screw stick 100 has three layers, namely an elongated gripping bar 60, a first elongated track plate 20 affixed to the bottom of the gripping bar 60, and a second elongated track plate 40 affixed to the top of the gripping bar 60. In the illustrated embodiments, the two plates 20, 40 are configured the same as one another.

A gripping slot 70 is extends in the gripping bar 60. The gripping slot 70 extends through the thickness of and along the length of the gripping bar 60. The gripping slot 70 is closed at its first end 72 at the first fastener slot end 11. The gripping slot 70 is open at its second end 73 at the fastener slot second end 13. In the illustrated embodiment, the second narrow portion 90 is formed by the gripping slot 70 at its second end 73. The gripping slot 70 includes a first wide portion 75 configured for accepting insertion of a fastener into the slot 10. In the illustrated embodiment, the wide portion 75 is at slot end 11. Next to the second narrow portion 90, the gripping slot 70 includes a second wide portion 85 that may be sized to grip or hold the fastener less firmly than in the rest of the first or the second slot sections 16, 18. The fastener slot 10 includes the gripping slot 70.

The gripping bar 60 includes an elastomeric material at the gripping slot 70 to grip the fasteners. In the illustrated embodiment the entire gripping bar is made of an elastomeric material; neoprene rubber may be used. In alternate embodiments, the gripping material may be magnetic. In other alternate embodiments, the gripping material may be at the inner surface of the gripping slot 70, but not extending throughout the entire gripping bar 60.

The screw stick 100 further includes a support material to support the elastomeric material. If the gripping bar needs it, support is desirable to help keep the gripping slot 70 and the narrow portions 80, 90 positioned to provide sufficient gripping force and resistance to movement of the fastener. In the illustrated embodiment the support material includes the first and second elongated track plates 20, 40 affixed, for example by a suitable adhesive, to the upper and lower surfaces, respectively, of the gripping bar 60.

A plate slot 21 extends in the first track plate 20. A plate slot 41 extends in the second track plate 40. The plate slots 21, 41 extend through the thickness of and along the length of the plates 20, 40, respectively. The plate slots 21, 41 are closed at their respective first ends 22, 42 at the first fastener slot end 11. The plate slots 41 are open at their respective second ends 24, 44 at the fastener slot second end 13. The plate slots 21, 41 each includes a respective wide portion 45 configured for accepting insertion of a fastener into the slot 10. In the illustrated embodiment, the plate wide portions 45 are at slot end 11. The fastener slot 10 includes the plate slots 21, 41.

The track plates 20, 40 are made of a material that is rigid for dimensional stability and tough to withstand hammer strikes and other rough treatment in use; steel may be used. In alternate embodiments, the support material may be positioned on only one side of the gripping bar, or may encase the gripping bar on all sides, and/or be positioned within the gripping bar.

In the illustrated embodiment, the gripping slot 70 is narrower that the support slots 21, 41. This allows for support slots 21, 41 to accept a fastener having a diameter sized to fit within the support slots 21, 41, while in friction gripping engagement with the elastomeric material, which may involve some deformation of the elastomeric material.

In use of the holder, such as for setting lag screws in a pole, a number of lag screws 110 are placed into the holder by inserting a screw into the wide portion 11 of the slot 10 and sliding it along the slot, positioning it in the first slot section 16. This may be repeated to load more screws in the holder 100. The first slot section 16 may hold one or more screws at a time. For example the first slot section 16 may be sized to hold a dozen or more screws, providing the tool 100 with a cartridge-like or magazine-like function. The ability of the tool 100 to hold a plurality of fasteners saves time versus having to reach for each fastener one at a time.

When a screw 110 is to be set in the pole, it is moved past the first narrow portion into the second slot section 18 as shown in FIG. 1. The screw may be moved all the way along the slot 10 to the second wide portion 85 at a position adjacent the second narrow portion 90, to position it farthest away from the hand. Then, grasping the holder 100 at its closed first end 12, the worker positions the lag screw at the pole and strikes it with a hammer to set it in the pole. The workman then pulls the holder 100 away from the set lag screw, so the screw moves through the second narrow portion 90 and exits the holder at the slot open end 13. The worker can then use a suitable driver to complete insertion of the screw into the pole. And, without having to re-load the holder 110, the process may be repeated with the other screws 110 already loaded in the holder and held in the first narrow portion 16.

While the foregoing has described in detail preferred embodiments known at the time, it should be readily understood that the invention is not limited to the disclosed embodiments. Rather, the invention can be modified to incorporate any number of variations, alterations, substitutions or equivalent arrangements not heretofore described, but which are commensurate with the spirit and scope of the invention. For example, while a hex head lag screw is illustrated as the fastener in the illustrated embodiments, other fastener types may be held, including nails, bolts, drywall screws, deck screws, wood screws, sheet metal screws, and other fastener types. Also, while a hammer is mentioned in the description of the illustrated embodiments as the driver, other driver types appropriate to the fastener may be used, including a drill, impact driver, screw driver or other driver. And other driver surface configurations may be used as appropriate for the fastener driving surfaces, including slot (flat), Phillips®, Pozidriv®, square, hex socket (Allen), torx, Tri-Wing®, Torq-Set®, Mortorq®, or other driver surface configurations. Accordingly, the invention is not to be seen as limited by the foregoing description

What is claimed as new and desired to be protected by Letters Patent of the United States is:

1. A fastener holder for holding a plurality of fasteners to be struck and set in a work piece, comprising: a fastener slot extending from a first end of the fastener holder to a second end of the fastener holder; the slot being adapted to hold the plurality of fasteners simultaneously in a friction gripping engagement, wherein the plurality of fasteners are of the same size and at least one of the plurality of fasteners is held to be struck and set in the work piece; the slot having an open end at its second end; the open end having an open end narrow portion; the open end narrow portion being configured to require applied force for the set fastener to slide through the slot to exit the fastener holder through the open end narrow portion, wherein the fastener holder is configured to hold the plurality of fasteners in friction gripping engagement in both a horizontal and a vertical orientation.

2. A fastener holder as in claim 1, wherein the fastener slot is sized for the corresponding fasteners such that a head of the corresponding fasteners is larger than a width of the fastener slot.

3. A fastener holder as in claim 1, wherein the fastener slot includes a wide portion configured for accepting insertion of a fastener into the slot.

4. A fastener holder as in claim 3, wherein the wide portion is proximate to the first end.

5. A fastener holder as in claim 3, wherein the fastener slot includes an open slot end and a closed slot end, and wherein the wide portion is at the closed slot end.

6. A fastener holder as in claim 1, wherein the fastener slot includes an elastomeric material in contact with the fastener.

7. A fastener holder as in claim 6, wherein the elastomeric material includes neoprene.

8. A fastener holder as in claim 6, further including a support material to support the elastomeric material.

9. A fastener holder as in claim 8, wherein the support material includes steel.

10. A fastener holder as in claim 1, wherein the fastener slot includes a closed slot end and the closed slot end is proximate to the first end of the fastener holder.

11. A fastener holder as in claim 10, wherein the fastener slot has a first slot section and a second slot section and a section narrow portion between the first slot section and the second slot section.

12. A fastener holder as in claim 10, wherein the second slot section extends from the section narrow portion to the open slot end.

13. A fastener holder as in claim 10, wherein the fastener slot is continuous from the open slot end to the closed slot end.

14. A fastener holder as in claim 1, further including a gripping bar, a gripping slot formed in the gripping bar, the fastener slot including the gripping slot.

15. A fastener holder as in claim 14, wherein the gripping bar includes an elastomeric material at the gripping slot to grip the fasteners, the holder further including a support material to support the elastomeric material.

16. A fastener holder as in claim 15, wherein the gripping bar has upper and lower surfaces, the support material is affixed to at least one of the upper and lower gripping bar surfaces, and the support material includes a support slot, the fastener slot including the support slot.

17. A fastener holder as in claim 16, wherein the gripping slot is narrower that the support slot.

18. A fastener holder as in claim 16, wherein the support material is affixed to at least one of the upper and lower gripping bar surfaces with an adhesive.

19. A fastener holder as in claim 17, wherein the section narrow portion and the open end narrow portions are formed in the gripping slot.

20. A method of setting fasteners in a work piece, comprising the steps of:

providing a fastener holder for holding a plurality of fasteners to be struck and set in a work piece, comprising: a fastener slot extending from a first end of the fastener holder to a second end of the fastener holder; the slot being adapted to hold the plurality of fasteners simultaneously in a friction gripping engagement, wherein the plurality of fasteners are of the same size and at least one of the plurality of fasteners is held to be struck and set in the work piece; the slot having an open end at its second end; the open end having an open end narrow portion; the open end narrow portion being configured to require applied force for the set fastener to slide through the slot to exit the fastener holder through the open end narrow portion, wherein the fastener holder is configured to hold the plurality of fasteners in friction gripping engagement in both a horizontal and a vertical orientation;

inserting more than 1 fastener into the slot section;

striking at least one of the fasteners in the slot section to set in the work piece; and moving the fastener holder away from the set fastener to slide the set fastener from the slot section through the narrow portion to exit the slot.

21. A method of setting fasteners in a work piece, comprising the steps of:

providing a fastener holder for holding a plurality of fasteners to be struck and set in a work piece, the holder including a slot having a first slot section and a second slot section; the first slot section for holding the plurality of fasteners and separated from the second slot section by a first narrow portion; the first narrow portion configured to require applied force for a fastener in the slot to slide through from the first slot section to the second slot section, where the fastener is held to be struck and set in the work piece and the first narrow portion has a width narrower than both the first slot section and the second slot section; the second slot section having an open end at the end of the slot; the open end having a second narrow portion; the second narrow portion configured to require applied force for the set fastener to slide through from the second slot section to exit the slot, wherein the fastener holder is configured to hold the plurality of fasteners in both a horizontal and vertical orientation;

inserting one or more fasteners into the first slot section;

sliding a fastener from the first slot section to the second slot section;

striking the fastener in the second slot section to set in the work piece;

moving the fastener holder to the set fastener to slide through from the second slot section to exit the slot.

22. A method of setting fasteners in a work piece as in claim 21, wherein one or more fasteners is more than one fastener.

* * * * *